US008181704B2

(12) United States Patent
Fenton

(10) Patent No.: US 8,181,704 B2
(45) Date of Patent: May 22, 2012

(54) RISER EMERGENCY DISCONNECT CONTROL SYSTEM

(75) Inventor: Stephen P. Fenton, Balmedie (GB)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 12/883,485

(22) Filed: Sep. 16, 2010

(65) Prior Publication Data

US 2012/0067589 A1 Mar. 22, 2012

(51) Int. Cl.
*E21B 7/12* (2006.01)

(52) U.S. Cl. ..... 166/338; 166/344; 166/345

(58) Field of Classification Search ..... 166/338, 166/340, 345, 363, 364, 368, 378, 381
See application file for complete search history.

(56) References Cited

U.S. PATENT DOCUMENTS

| | | | | |
|---|---|---|---|---|
| 3,333,870 | A | 8/1967 | Watkins | |
| 3,675,713 | A | 7/1972 | Watkins | |
| 3,695,633 | A | 10/1972 | Hanes | |
| 3,841,665 | A | 10/1974 | Capot | |
| 4,411,455 | A * | 10/1983 | Schnatzmeyer | 285/39 |
| 4,452,472 | A | 6/1984 | Crase | |
| 4,469,136 | A | 9/1984 | Watkins | |
| 4,491,345 | A | 1/1985 | Regan | |
| 4,611,662 | A * | 9/1986 | Harrington | 166/339 |
| 4,809,747 | A | 3/1989 | Choly | |
| 4,902,044 | A | 2/1990 | Williams | |
| 5,433,274 | A | 7/1995 | Graff | |
| 5,634,671 | A | 6/1997 | Watkins | |
| 5,992,893 | A | 11/1999 | Watkins | |
| 6,015,013 | A | 1/2000 | Edwards | |
| 6,053,252 | A | 4/2000 | Edwards | |
| 6,102,124 | A | 8/2000 | Skeels et al. | |
| 6,129,151 | A | 10/2000 | Crotwell | |
| 6,315,330 | B1 | 11/2001 | Byerly | |
| 6,595,552 | B1 | 7/2003 | Mortari | |
| 6,659,690 | B1 | 12/2003 | Abadi | |
| 7,234,347 | B2 | 6/2007 | Harthorn | |
| 7,328,741 | B2 | 2/2008 | Allen | |
| 7,578,349 | B2 * | 8/2009 | Sundararajan et al. | 166/363 |
| 2002/0176748 | A1 * | 11/2002 | Carter | 405/224.2 |

(Continued)

FOREIGN PATENT DOCUMENTS

GB 2405163 A 2/2005

(Continued)

OTHER PUBLICATIONS

GB Search Report issued Nov. 6, 2011 in corresponding Application No. GB19159647.

*Primary Examiner* — Thomas Beach
*Assistant Examiner* — Aaron Lembo
(74) *Attorney, Agent, or Firm* — Bracewell & Giuliani LLP

(57) ABSTRACT

An emergency riser disconnection system for disconnecting a riser from a subsea installation having disconnect actuators and a signal and power circuit for controlling the actuators. The signal and power circuit is made up of an umbilical with signal lines and hydraulic lines. At an umbilical termination, the signal and hydraulic lines exit the umbilical and can be routed separately to the disconnect actuators. The umbilical termination is disposed above the uppermost break away point on the riser and can be recovered after the riser is disconnected.

17 Claims, 3 Drawing Sheets

U.S. PATENT DOCUMENTS

| | | | | |
|---|---|---|---|---|
| 2003/0145995 | A1* | 8/2003 | Andersen et al. | 166/345 |
| 2004/0173356 | A1* | 9/2004 | Dore et al. | 166/345 |
| 2005/0100414 | A1* | 5/2005 | Salama | 405/224.2 |
| 2006/0042799 | A1 | 3/2006 | Hosie et al. | |
| 2006/0151175 | A1 | 7/2006 | Sundararajan | |
| 2006/0157252 | A1* | 7/2006 | Dore et al. | 166/358 |
| 2008/0105435 | A1 | 5/2008 | Inderberg | |
| 2009/0229830 | A1 | 9/2009 | Kerr | |
| 2010/0012326 | A1 | 1/2010 | Sundararajan et al. | |

FOREIGN PATENT DOCUMENTS

| | | | |
|---|---|---|---|
| WO | 2010042873 | A2 | 4/2010 |

* cited by examiner

RISER EMERGENCY DISCONNECT CONTROL SYSTEM

FIELD OF THE INVENTION

This invention relates in general to production of oil and gas wells, and in particular to a device and method for unloading, and clean up of fluids from a well.

DESCRIPTION OF RELATED ART

Subsea risers are tubular members extending from the sea surface to seafloor. When encasing a drill string during subsea drilling, a riser typically spans between a drilling rig to a blowout preventer (BOP) and Lower Marine Riser Package (LMRP); that in turn connects to a subsea wellhead. When used during production of hydrocarbons from subsea formations, a riser typically connects between a surface vessel to a subsea wellhead system. Tensioning systems are generally included that axially tension the riser for reducing lateral deflection from sea current side loading. In some instances, such as during a storm or unplanned deviation of location of the support vessel with respect to the well location, lateral loads can exceed structural integrity of the riser. To anticipate riser failure from such loads, risers often include emergency systems to allow a controlled disconnection between the sea surface and seafloor along the riser.

A prior art example of a subsea exploration/production system 10 is shown in a side schematic view in FIG. 1. A riser 12 extends from above the sea surface 13 to a well system 14. Platform 16 (typically a vessel of some description) provides the upper support for the riser 12 and from which a tensioning system (not shown) may be secured. Well system 14 includes a lower riser package 18 coupled with a production tree 20 that mounts onto a wellhead at the sea floor 22. The well system 14 is disposed over a bore hole 24 shown intersecting a subsea formation 26. Also provided is an umbilical 28 that typically includes control lines and power lines for actuating subsea mechanisms. An umbilical termination 30 is often provided on the lower end of the umbilical 28 and provides a mounting point for the umbilical 28 to the well system 14. Typically at least one signal control line 31 attaches between the umbilical termination 30 and a subsea electronic module 32. A hydraulic circuit 33 connects to the umbilical termination 30 and to actuation modules 34, 36 shown in the lower riser package 18. An example of a signal and hydraulic control scheme may be found in GB2405163A, which was assigned to the assignee of the present application and is incorporated by reference herein in its entirety.

SUMMARY OF THE INVENTION

Disclosed herein is a riser disconnect system for disconnecting a riser between the sea surface and seafloor, having features that incorporate additional system safety features and employing a distributed controls architecture to simplify the complexity of the safety disconnection interfaces. In an example embodiment, a riser disconnect system includes a break-away safety joint (often referred to as a weak link), located at some distance above the stress joint, it located above the EDP (Emergency Disconnect Package) of an LRP. An umbilical is carried by and attached to the riser, providing control signal line(s) and an actuation power supply. Actuated functions are included at one of a plurality of disconnection points along the riser and are energized in response to communication down the umbilical to the SEM to direct hydraulic power to discrete actuate functions. Also included is an umbilical termination that connects to the umbilical. The umbilical termination is disposed between the uppermost disconnection point and the sea surface, so that when the riser is disconnected to breakaway from the seafloor, the umbilical termination can be recovered. In an example embodiment, the signal line and actuation power line separate from the umbilical at the umbilical termination. The riser disconnect system includes a subsea electronic module (SEM) that has an input side attached to the signal line; additional signal lines attach between outputs of the SEM and a plurality of hydraulic mini-modules providing the direction of accumulated hydraulic control fluid pressure to any or all actuated functions. The actuation power line can, in an alternative embodiment, be a hydraulic fluid line that carries hydraulic fluid to the actuators. In an example, additional hydraulic fluid lines are included that define a hydraulic circuit. Accumulators can optionally be included that receive fluid from the hydraulic circuit and or lines. An output on each accumulator can attach to optionally included additional actuators; where the additional actuators are provided at the disconnection points along the riser In an example embodiment, the actuator is made up of a module coupled to a riser disconnect mechanism. The module can selectively change into an open position that communicates power to the riser disconnect mechanism. A power input can be included with the module that delivers power from the power line. The module can also have a signal input for receiving signals from the signal line. Also optionally included are power output lines with the riser disconnect system that form a power distribution circuit. A controller can receive a signal input and delivering power through one or more of the power output lines.

The present disclosure also describes an offshore riser system that is made up of a riser, disconnection points along a length of the riser, riser disconnection modules coupled to the disconnection points on the riser, an umbilical suspended beneath the surface of the sea and having an umbilical termination at a lower depth, a signal line extending from the umbilical termination to each of the riser disconnection modules, and a hydraulic power line extending from the umbilical termination to each of the riser disconnection modules. In one example embodiment, the umbilical termination is above an uppermost one of the disconnection points and below the sea surface. This allows recovery of the umbilical termination when the riser is disconnected to breakaway from the seafloor. A subsea electronic module (SEM) can be included that has an input connected to the signal line. An output can be provided with the SEM that connect to output and each of the riser disconnection modules. An emergency disconnect package can be included proximate where the riser connects to a wellhead assembly on the seafloor and a riser safety joint may be included that is disposed above the emergency disconnect package. The emergency disconnect package and riser safety joint can each include an associated disconnection module. In an embodiment, a hydraulic circuit is defined between the umbilical termination and each of the riser disconnection modules. Each riser disconnection module can be coupled to a riser disconnect mechanism at the disconnection point on riser, wherein the riser disconnection module is selectively changeable to an open position to communicate power to the riser disconnect mechanism. In an example embodiment, the riser disconnection module includes a hydraulic input in fluid communication with the hydraulic power line, a signal input in signal communication with the signal line, a valved manifold with a plurality of hydraulic power output lines, and a controller for receiving a signal input and flowing hydraulic fluid through one or more of the hydraulic power output lines.

Yet further described herein is an example embodiment of a subsea system that is made of a riser projecting upward from a subsea installation on the seafloor. In this example, disconnecting joints may be included on the riser with each having an associated disconnection actuator. An umbilical may be suspended subsea and adjacent the riser that has a signal line connected to the disconnection actuators. The umbilical can also have therein a power line for delivering power to the disconnection actuators and an umbilical termination coupled with the umbilical that is below the sea surface and above a disconnection joint closest to the sea surface. This allows recovery of the umbilical termination when any of the disconnection actuators are actuated to disconnect the riser. An SEM can be coupled to the signal line on an input side of the subsea electronic module and signal lines coupled on one end to an output side of the subsea electronic module and on another end to the disconnection actuators. In an example embodiment, the power line is a hydraulic fluid line that carries hydraulic fluid to the disconnection actuators. The system can also alternatively include accumulators that each connect to the hydraulic fluid lines and supply pressurized hydraulic fluid to an associated disconnection actuator.

DETAILED DESCRIPTION OF THE INVENTION

Figure 1:
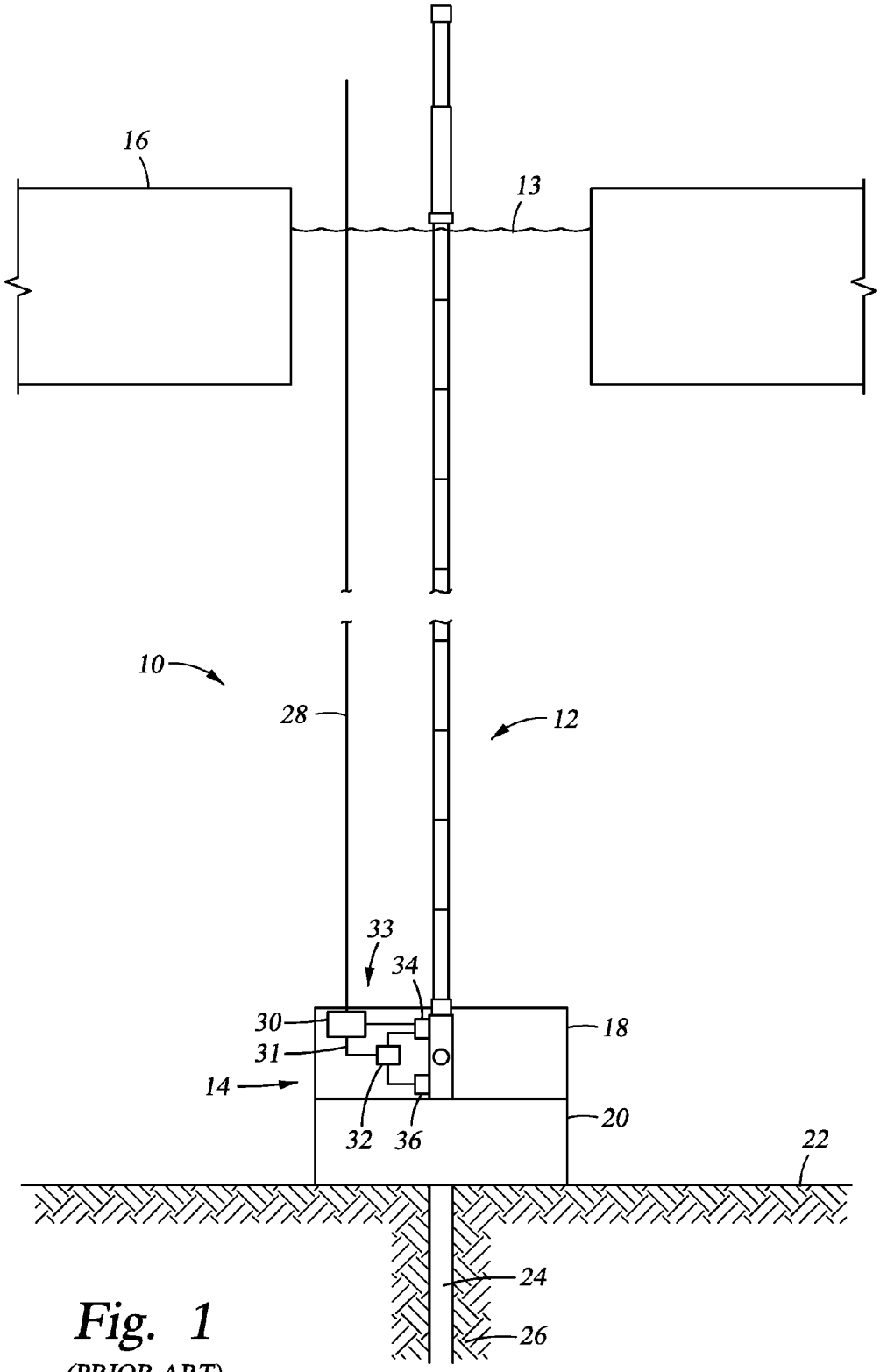
Fig. 1 (PRIOR ART)
FIG. 1 is a side schematic view of a prior art embodiment of a subsea exploration/production system having a riser disconnect system.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Figure 2:
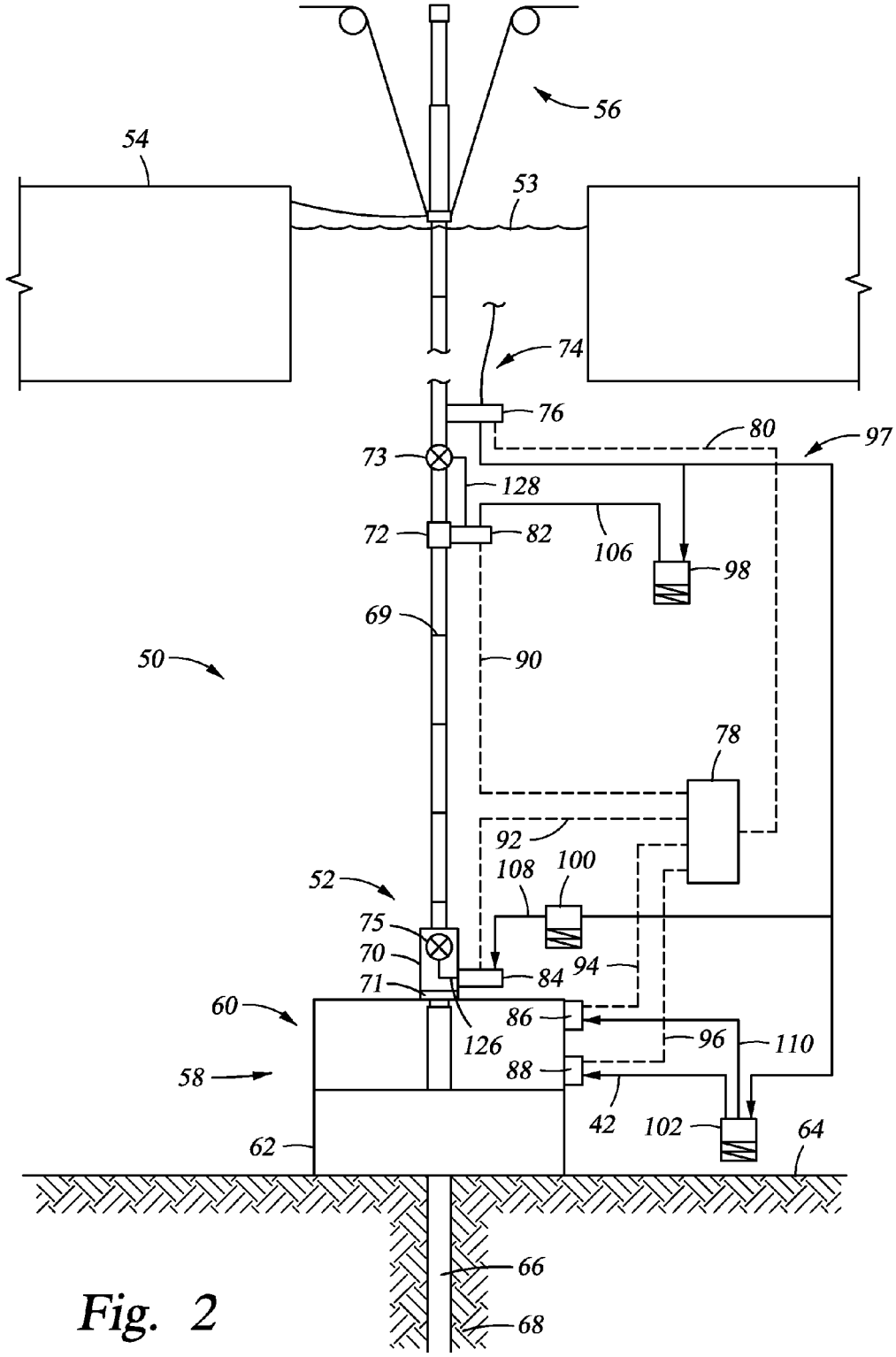
FIG. 2 is a side schematic view of an example embodiment of a subsea exploration/production system having a riser disconnect system.

Show in a side schematic view in FIG. 2 is an example embodiment of a subsea exploration and production system 50 in accordance with the present disclosure. The subsea exploration and production system 50 of FIG. 2 includes an emergency disconnect system or breakaway for a riser 52. The riser 52 as shown extends subsea beneath the sea surface 53 and shown supported on its upper end along a platform 54. Examples of the platform 54 include a drilling rig as well as a production vessel, such as a loading production storage and offloading unit. A tensioning system 56 may be included as shown mounted above the platform 54 for imparting an axial tension within the riser 52. The lower end of the riser 52 couples with a wellhead assembly 58 that includes a lower riser package 60 and production tree 62. The wellhead assembly 58 of FIG. 2 is shown mounted on the sea floor 64. The wellhead assembly 58 is set over a bore hole 66 that extends downward from the sea floor 64 and formed through a subsea formation 68.

Joints 69 are shown formed at various locations along the length of the riser 52. As discussed in greater detail below, actuators may be provided at one or more of these joints 69 to break away or sever the riser 52 at or along a joint 69. In one example, an emergency disconnect package 70 is shown attached with a connector 71 to the riser 52 set adjacent to where the riser 52 attaches to the wellhead assembly 58. It is believed that forming and installing a disconnect package 70 is within the capabilities of those skilled in the art. A riser safety joint 72 is an additional example of a breakaway that is shown on the riser 52 and set above the emergency disconnect package 70. The riser 52 may optionally include an upper riser containment valve 73 as shown within the riser 52 above the riser safety joint 72 and a lower riser containment valve 75 at the emergency disconnect package 70. Also illustrated in FIG. 2 is an umbilical 74 that is suspended subsea adjacent the riser 52. Optionally, the umbilical 74 may be coupled to the riser 52. The umbilical 74 has a lower end anchored at an umbilical termination 76. The umbilical termination 76 is in signal communication with a subsea electronic module 78 via a signal line 80 that extends from the umbilical termination 76 to an input connection on the subsea electric module 78.

Actuation modules 82, 84, 86, 88 are provided respectively on the riser safety joint 72, emergency disconnect package 70, and the wellhead assembly 58. In an example embodiment, the actuation modules 82, 84, 86, 88 provide for actuation of an actuator(s), an actuation device(s), a valve(s), BOP ram, or a mechanical device(s) located in one or more of the emergency disconnect package 70, riser safety joint 72, and wellhead assembly 58. A signal line 90 shown connected between the subsea electronic module 78 and actuation module 82 may convey control signals for operational control of the actuation module 82. Similar signal lines 92, 94, 96 can provide signal communication between the subsea electronic module 78 and actuation modules 84, 86, 88. The signal lines 80, 90, 92, 94, 96 can be any medium for transmitting signals, where the signals can be electrical, acoustic, or electromagnetic, such as a radio waves or optical signals.

The actuation modules 82, 84, 86, 88 may be powered by electricity, compressed gas, as well as hydraulic fluid. In the example embodiment of FIG. 2, a hydraulic circuit 97 is shown providing fluid communication between the umbilical termination 76 and accumulators 98, 100, 102. The accumulators 98, 100, 102 are in respective fluid communication with each of the actuation modules 82, 84, 86, 88 via hydraulic lead lines 106, 108, 110, 112. In an example embodiment, the accumulators 98, 100, 102 include a vessel or other container in which pressurized fluid is stored for use by the actuators 82, 84, 86, 88 when desired. In the example of FIG. 2, actuation modules 82 and 88 each have respective dedicated accumulators 98, 100. Whereas, actuation modules 86, 88 share a single accumulator 102. Example embodiments exist wherein each actuation module includes a dedicated accumulator, or more than two actuation modules are in fluid communication with a single accumulator.

It should be pointed out that the umbilical termination 76 is set above the upper most breakaway point, i.e. the riser safety joint 72 and associated actuation module 82. Accordingly, in situations when it is necessary to disconnect the riser 52 from the wellhead assembly 58, the umbilical termination 76 can be recovered along with the disconnected portion of the riser 52.

Figure 3:
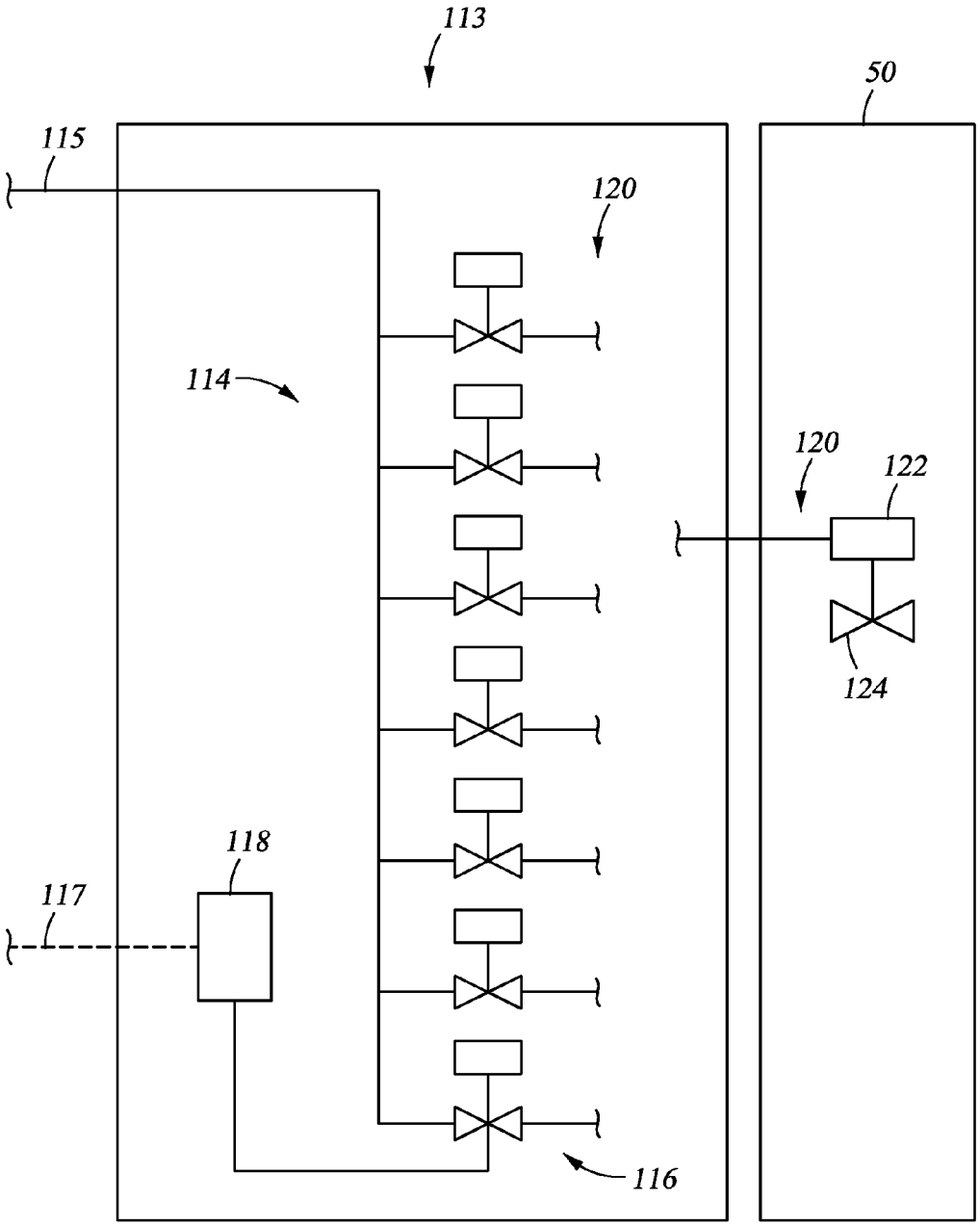
FIG. 3 is a schematic view of an example embodiment of a subsea module for use with a riser disconnect system.

A schematic example of an actuation module 113 is provided in side view in FIG. 3, wherein the actuation module 113 is an illustrative example of any or all the actuation modules 82, 84, 86, 88. In this embodiment, the actuation module 113 includes a hydraulic manifold 114 in fluid communication with a hydraulic power line 115; wherein the hydraulic power line 115 is representative of one or more of the hydraulic lead lines 106, 108, 110, 112. Motor operated valves 116 are shown included within each leg of the manifold 114 for directing fluid flow through each of the legs. The motor operated valves 116 may be controlled to open, close, or partially close via control signals delivered from a signal line 117 to a controller 118. The signal line 117 is representative of one or more of the signal lines 90, 92, 94, 96. In the example embodiment of FIG. 3, an end (not shown) of the power line 115 opposite the manifold 114 connects to an accumulator that is in fluid communication with the hydraulic circuit 97. Additionally, the signal line 117 is in signal communication with the subsea electronic module 78. Optionally, one or both of the power line 115 and signal line 117 may be in direct communication with the umbilical 74. Exit lines 120 are shown illustrated downstream of the motor operated valves 116; each exit line 120 couples with a device, such as an actuator or connector, provided within the subsea exploration/production system 50. In the example of FIG. 3, an actuator 122 is shown attached to a valve 124, wherein the actuator is selectively powered for opening/closing the valve 124 when fluid is selectively delivered through line 120. The actuation module 113 may attach directly to a portion of the production system 50, or can be mounted adjacent the production system 50 and the exit lines 120 extending between the actuation module 113 and the device being powered or actuated. Examples of devices being powered or actuated include the connector 71, the riser safety joint 72, and the upper and lower riser containment valves 73, 75 (FIG. 2). Supply lines 126, 128 can convey actuating fluid from the actuation modules 82, 84 to the upper and lower riser containment valves 73, 75.

In an example of operation of the subsea exploration/production system 50 of FIG. 2, the umbilical 74 provides power and control. Power from the umbilical 74 can be transmitted as either electrical, pneumatic, or from pressurized hydraulic fluid. The power can be delivered directly to the actuation modules 82, 84, 86, 88, or converted to another form of power for delivery to the actuation modules 82, 84, 86, 88 or other devices subsea. In the example of hydraulic fluid power, transmission can occur by flowing pressurized hydraulic fluid through the hydraulic circuit 97 to the accumulators 98, 100, 102. Control, such as actuation, deactivation, and operational rate, can take place by transmitting a signal(s) via the signal line 80 to the SEM 78. In an example embodiment, the SEM 78 distributes the signal(s) received from the signal line 80 to one or more of the signal lines 90, 92, 94, 96 for transmission to a respective actuation module 82, 84, 86, 88. Thus the SEM 78 can be or operate the same as or similar to a multiplexer. As explained above in the description of FIG. 3, in response to the signal delivered to an actuation module 82, 84, 86, 88, fluid maintained in an accumulator 98, 100, 102 is routed through an actuation module 82, 84, 86, 88 and delivered to a designated actuator.

When required or otherwise desired, the riser 52 can be decoupled from the wellhead assembly 58 by signals delivered through one or more of the signal lines 80, 90, 92, 94, 96 and optional SEM 78. Power for decoupling can occur from the hydraulic circuit 97. Decoupling can involve actuating one or each of the riser safety joint 72 and connector 71 in the emergency disconnect package 70. Decoupling can also include closing the upper and lower riser containment valves 73, 75 via the actuation modules 82, 84. After disconnecting the riser 52 from the wellhead assembly 58, the platform 54 and portion of the riser 52 above the riser safety joint 72 can be relocated to another area if necessary. The signal lines 80 and power lines are severed at a point below the umbilical termination 76 to allow the umbilical 74 (and termination 76) to be relocated with the platform 54 and decoupled portion of the riser 52.

While the invention has been shown or described in only some of its forms, it should be apparent to those skilled in the art that it is not so limited, but is susceptible to various changes without departing from the scope of the invention.

What is claimed is:

1. A riser disconnect system for disconnecting a riser between the sea surface and seafloor, the riser disconnect system comprising:

a safety joint provided in a mid portion of the riser;

an umbilical suspended subsea;

a signal line in the umbilical;

an actuation power line in the umbilical;

an umbilical termination provided subsea above the safety joint;

an emergency disconnect package provided proximate to where the riser attaches to a subsea wellhead assembly; and a power module in selective signal communication with the signal line and in power communication with the actuation power line, and selectively moveable in response to a signal in the signal line from an open position with the actuation power line in power communication with an actuator on the riser and to a closed position so the actuation power line is isolated from the actuator.

2. The system of claim 1, wherein the umbilical termination defines where the signal line and actuation power line separate from the umbilical.

3. The system of claim 1, further comprising a subsea electronic module for selectively putting the power module in signal communication with the signal line and that is coupled to the signal line on an input side of the subsea electronic module and signal lines coupled on one end to an output side of the subsea electronic module and on another end to the power module.

4. The system of claim 1, wherein the actuation power line comprises a hydraulic fluid line that carries hydraulic fluid to the power module.

5. The system of claim 4, further comprising additional hydraulic fluid lines that define a hydraulic circuit.

6. The system of claim 5, further comprising accumulators, each having an input in fluid communication with one of the hydraulic fluid lines and an output, wherein additional power modules are provided subsea and each accumulator output is in fluid communication with one of the power modules.

7. The system of claim 1, wherein the actuator comprises a device selected from the group consisting of a valve actuator, a BOP ram actuator, and a riser connection actuator.

8. The system of claim 1, wherein the power module comprises a power distribution circuit with a plurality of power output lines, and a controller for receiving a signal input and delivering power through one or more of the power output lines.

9. The system of claim 1, wherein the umbilical termination disposed between an uppermost one of the disconnection points and the sea surface, so that when the riser is disconnected to breakaway from the seafloor, the umbilical termination is recoverable.

10. The system of claim 3, wherein the power module is distinct and set apart from the subsea electronic module and the actuator.

11. An offshore riser system comprising:

a riser coupled to a subsea wellhead assembly;

a disconnection actuator mounted to the riser proximate the subsea wellhead assembly and another disconnection actuator mounted to a mid portion of the riser;

power modules in selective power communication with the actuators;

an umbilical suspended beneath the surface of the sea having an umbilical termination at a lower depth that is above the disconnection actuator mounted to a mid portion of the riser;

a signal line extending from the umbilical termination;

a hydraulic power line extending from the umbilical termination and in fluid communication with the power modules; and subsea electronic module connected with the signal line and the power modules for selectively providing signal communication between the signal line and the power modules.

12. The system of claim 11, further comprising a hydraulic circuit defined between the umbilical termination and each of the power modules.

13. The system of claim 11, wherein the riser disconnection actuator comprises a hydraulic input in fluid communication with the hydraulic power line, a signal input in signal communication with the signal line, a valved manifold with a plurality of hydraulic power output lines, and a controller for receiving a signal input and flowing hydraulic fluid through one or more of the hydraulic power output lines.

14. A subsea system comprising:

a riser depending subsea to an installation on the seafloor;

disconnecting joints on the riser each having a disconnection actuator and that are located proximate the seafloor and a mid portion of the riser;

an umbilical suspended subsea and adjacent the riser;

a signal line in the umbilical in communication with a subsea electronic module;

a power line in the umbilical in power communication with the disconnection actuators;

an umbilical termination coupled with the umbilical below the sea surface; and signal leads connected between the electronic module and the disconnection actuators that define a distributed control circuit for controlling the actuators.

15. The system of claim 14, further comprising a subsea electronic module having an input coupled to the signal line and distributed signal lines coupled to an output side of the subsea electronic module and to the disconnection actuators.

16. The system of claim 14, wherein the power line comprises a hydraulic fluid line that carries hydraulic fluid to the disconnection actuators.

17. The system of claim 15, further comprising accumulators each having an input in fluid communication with one of the hydraulic fluid lines and an output in fluid communication with one of the disconnection actuators.

* * * * *